US005678817A

United States Patent [19]

Saito et al.

[11] Patent Number: 5,678,817

[45] Date of Patent: Oct. 21, 1997

[54] SHEET SEPARATING DEVICE WITH AUTOMATIC ADJUSTMENT OF DISTANCE BETWEEN FEED ROLLER AND RETARD ROLLER

[75] Inventors: Yoshihiro Saito, Hachiouji; Takeshi Yamaguchi, Kawasaki, both of Japan

[73] Assignee: Canon Kabushiki Kaisha, Tokyo, Japan

[21] Appl. No.: 528,421

[22] Filed: Sep. 14, 1995

[30] Foreign Application Priority Data

Sep. 19, 1994 [JP] Japan ..... 6-223100

[51] Int. Cl.[6] ..... B65H 3/52

[52] U.S. Cl. ..... 271/122; 271/125

[58] Field of Search ..... 271/10.03, 10.11, 271/10.13, 110, 111, 122, 125, 265.04, 262

[56] References Cited

U.S. PATENT DOCUMENTS 5,435,540 7/1995 Martin et al. ..... 271/125
5,449,162 9/1995 Saito .

FOREIGN PATENT DOCUMENTS 0214537 8/1989 Japan ..... 271/122
5-186082 7/1993 Japan .

*Primary Examiner*—H. Grant Skaggs
*Attorney, Agent, or Firm*—Fitzpatrick, Cella, Harper & Scinto

[57] ABSTRACT

A sheet feeding device has a feed roller with a plurality of large-diameter portions and a retard roller having a plurality of large-diameter portions alternately disposed with respect to the large-diameter portions of the feed roller. Originals are individually separated between the feed roller and the retard roller. The distance between the two rollers is automatically adjusted so that when a load caused by a separated sheet in a sheet feeding direction is large, the amount of overlap between the large-diameter portions of the two rollers is reduced, and when the load is small, the amount of overlap is increased. Thus, optimum separation is performed in accordance with the thickness of the sheet and the coefficient of friction of the surface of the sheet.

16 Claims, 7 Drawing Sheets

SHEET SEPARATING DEVICE WITH AUTOMATIC ADJUSTMENT OF DISTANCE BETWEEN FEED ROLLER AND RETARD ROLLER

BACKGROUND OF THE INVENTION

2. Field of the Invention

This invention relates to a sheet feeding device to be mounted in an electronic filing apparatus, a copier, a facsimile apparatus or the like.

2. Description of the Related Art

A mechanism for individually separating and feeding mounted sheets of-originals has been known in which, as shown in FIG. 7, so-called comb-shaped rollers 101 and 102 having large-diameter portions 101*a* and 102*a*, and small-diameter portions 101*b* and 102*b* are disposed so that the large-diameter portions 101a face the small-diameter portions 102*b*, and the small-diameter portions 101*b* faces the large-diameter portions 102*a*. The roller 101 having a large frictional force with a sheet is rotated in a forward direction (feeding direction), and the roller 102 having a small frictional force with a sheet is rotated in a reverse direction, whereby the sheets are individually separated and fed.

According to the above-described configuration, the rollers 101 and 102 do not contact each other, and the separation force of the rollers is easily adjusted by changing the amount of overlap between the rollers 101 and 102 by changing the center distance between the rollers. Hence, such a configuration is suitable when feeding the sheets at high speed, or when durability is required for the rollers.

In the above-described separation mechanism, however, the amount of overlap between the rollers 101 and 102 must be changed in order to provide an appropriate separation force in accordance with the thickness of sheets to be fed. If the separation force is improper, a failure in feeding or the feeding of a plurality of sheets at a time, may occur. Conventionally, the amount of overlap is manually adjusted, and therefore only skilled operators can deal with the apparatus. When originals have different thicknesses, they cannot be fed from a single stack, thereby causing inferior operability.

In order to solve such problems, the inventors of the present invention have proposed, in Japanese Patent Laid-Open Application (Kokai) No. 5-186082 (1993), a method, in which, recognizing that the load applied to comb-shaped rollers changes in accordance with the thickness of a sheet, the load applied to the comb-shaped rollers is detected, and the center distance between the rollers is controlled so that the load always has a constant value.

In this method, a differential mechanism, such as a planetary gear or the like, is used. When the load applied to one of the comb-shaped rollers exceeds a set value, the drive transmitted to the comb-shaped roller is applied by the differential mechanism to means for changing the center distance between the comb-shaped rollers, so that the center distance between the comb-shaped rollers is increased, i.e., the amount of overlap is reduced, as the thickness of the original increases. After the feeding of each original has been completed, the center distance between the comb-shaped rollers is retarded to the initial minimum value (the maximum amount of overlap) by a resetting operation.

Even in this method, however, when the load applied to the comb-shaped rollers changes as the original is fed (for example, when a seal is attached to the original), and the center distance between the comb-shaped rollers changes significantly, it is impossible to reduce the center distance between the comb-shaped rollers unless a resetting operation is intentionally performed. As a result, originals cannot be individually separated, and a failure in separation, in which a plurality of originals are fed at a time, may occur.

SUMMARY OF THE INVENTION

It is an object of the present invention to provide a sheet feeding device which can improve its separation performance by automatically adjusting the relative position between a feeding rotating member and a separating member so that a load caused by a sheet entering between the feeding rotating member and the separating member in a sheet feeding direction is always substantially constant.

It is another object of the present invention to provide a sheet feeding device which can improve its separation performance by automatically adjusting an amout of overlap between the large-diameter portions of a feeding rotating member and the large-diameter portions of an inversely rotating member so that a load caused by a sheet entering between the feeding rotating member and the inversely rotating member, having alternately disposed large-diameter portions, is always substantially constant.

According to one aspect, the present invention, which achieves these objectives, relates to a sheet feeding device comprising a feeding rotating means for feeding sheets in a sheet feeding direction, separating means opposed to the feeding rotating means for separating the sheets one by one, and automatic adjustment means for automatically adjusting a relative position between the feeding rotating member and the separating member so that when a load caused by a sheet entering between the feeding rotating member and the separating member in the sheet feeding direction is greater than a predetermined value, the load is reduced, and when the load is smaller than the predetermined value, the load is increased.

According to another aspect, the present invention relates to a sheet feeding device comprising a feeding rotating member having a plurality of large-diameter portions and rotating in a direction for feeding a sheet in a sheet feeding direction, an inversely rotating member having a plurality of large-diameter portions alternately disposed with respect to the large-diameter portions of the feeding rotating member and rotating in a direction tending to move a sheet in a direction reverse to the sheet feeding direction, and automatic adjustment means for automatically adjusting an amount of overlap between the large-diameter portions of the feeding rotating member and the large-diameter portions of the inversely rotating member so that when a load caused by a sheet entering between the feeding rotating member and the separating member in the sheet feeding direction is greater than a predetermined value, the amount overlap is reduced, and when the load is smaller than the predetermined value, the amount of overlap is increased.

According to still another aspect, the present invention relates to a sheet feeding device comprising a feeding rotating member having a plurality of large-diameter portions and rotating in a direction for feeding a sheet in a sheet feeding direction, an inversely rotating member having a plurality of large-diameter portions alternately disposed with respect to the large-diameter portions of the feeding rotating member and rotating in a direction tending to move a sheet in a direction reverse to the sheet feeding direction, and automatic adjustment means for automatically adjusting an amount of overlap between the large-diameter portions of the feeding rotating member and the large-diameter portions of the inversely rotating member. The automatic adjustment means further comprises moving means for moving the feeding rotating member and the inversely rotating member in an approaching direction or in a separating direction, and an operation means for causing the moving means to perform an approaching operation or a separating operation in accordance with a load caused by a sheet entering between the feeding rotating member and the inversely rotating member in the sheet feeding direction.

According to still another aspect, the present invention relates to an image reading apparatus comprising a feeding rotating means for feeding sheets in a sheet feeding direction, separating means opposed to the feeding rotating means for separating the sheets one by one, automatic adjustment means for automatically adjusting a relative position between the feeding rotating means and the separating means so that when a load caused by a sheet entering between the feeding rotating means and the separating means in the sheet feeding direction is greater than a predetermined value, the load is reduced, and when the load is smaller than the predetermined value, the load is increased, and reading means for reading an image formed on a sheet separated by the feeding rotating member and the separating means.

According to still another aspect, the present invention relates to an image reading apparatus comprising a feeding rotating member having a plurality of large-diameter portions and rotating in a direction for feeding a sheet in a sheet feeding direction, an inversely rotating member having a plurality of large-diameter portions alternately disposed with respect to the large-diameter portions of the feeding rotating member and rotating in a direction tending to move a sheet in a direction reverse to the sheet feeding direction, automatic adjustment means for automatically adjusting an amount of overlap between the large-diameter portions of the feeding rotating member and the large-diameter portions of the inversely rotating member so that when a load caused by a sheet entering between the feeding rotating means and the separating means in the sheet feeding direction is greater than a predetermined value, the amount of overlap is reduced, and when the load is smaller than the predetermined value, the amount of overlap is increased, and reading means for reading an image formed on a sheet separated by the feeding rotating member and the separating means.

According to still another aspect, the present invention relates to an image reading apparatus comprising a feeding rotating member having a plurality of large-diameter portions and rotating in a direction for feeding a sheet in a sheet feeding direction, an inversely rotating member having a plurality of large-diameter portions alternately disposed with respect to the large-diameter portions of the feeding rotating member and rotating in a direction tending to move a sheet in a direction reverse to the sheet feeding direction, automatic adjustment means for automatically adjusting an amount of overlap between the large-diameter portions of the feeding rotating member and the large-diameter portions of the inversely rotating member, wherein the automatic adjustment means further comprises moving means for moving the feeding rotating member and the inversely rotating member in an approaching direction or in a separating direction, and an operation means for causing the moving means to perform an approaching operation or a separating operation in accordance with a load applied to a sheet entering between the feeding rotating member and the inversely rotating member in the sheet feeding direction, and reading means for reading an image formed on a sheet separated by the feeding rotating member and the separating means.

The foregoing and other objects, advantages and features of the present invention will become more apparent from the following detailed description of the preferred embodiment taken in conjunction with the accompanying drawings.

DETAILED DESCRIPTION OF THE PREFERRED EMBODIMENT

Figure 1:
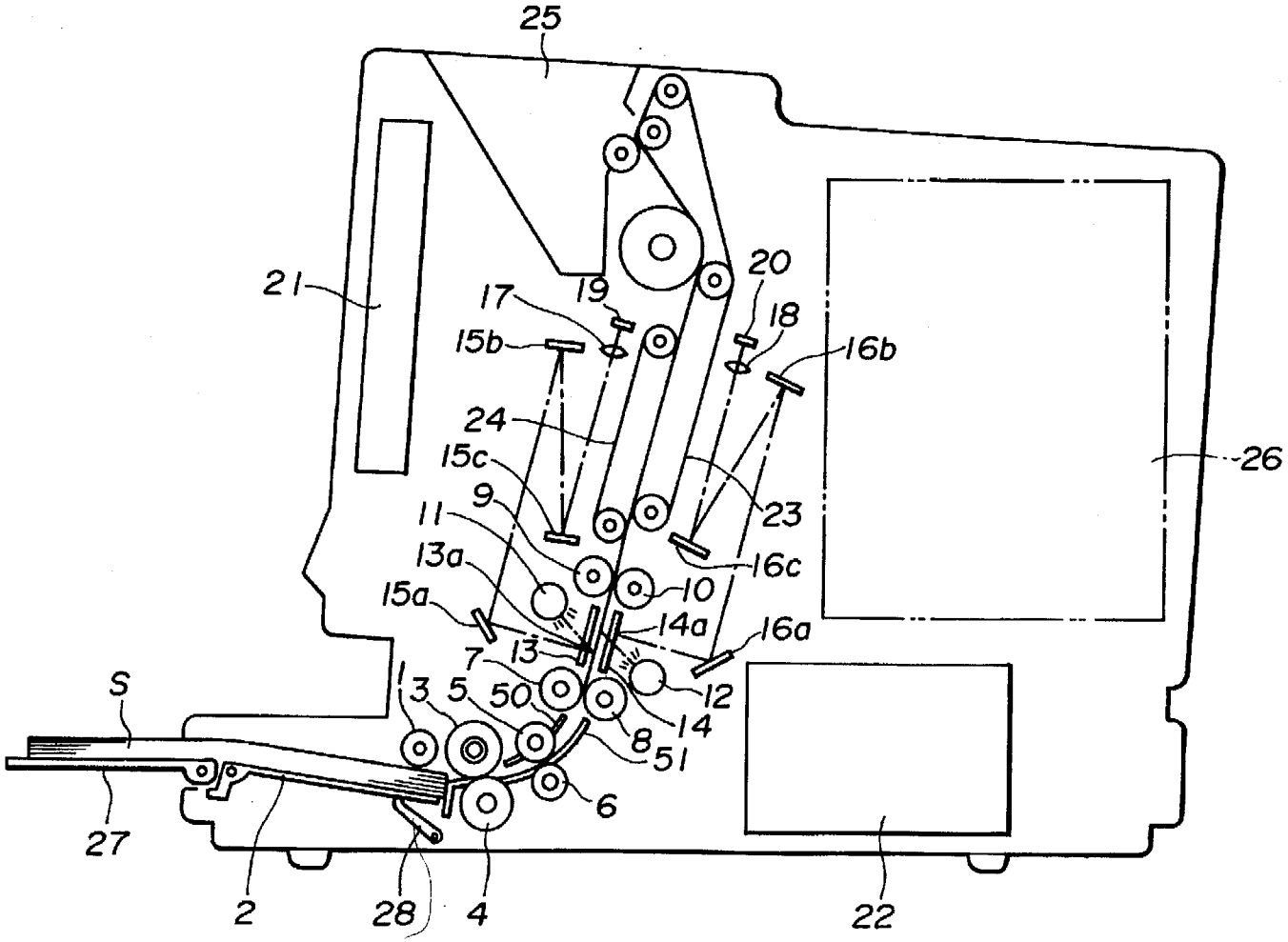
FIG. 1 is a cross-sectional view illustrating the entire configuration of an electronic filing apparatus.
Figure 2:
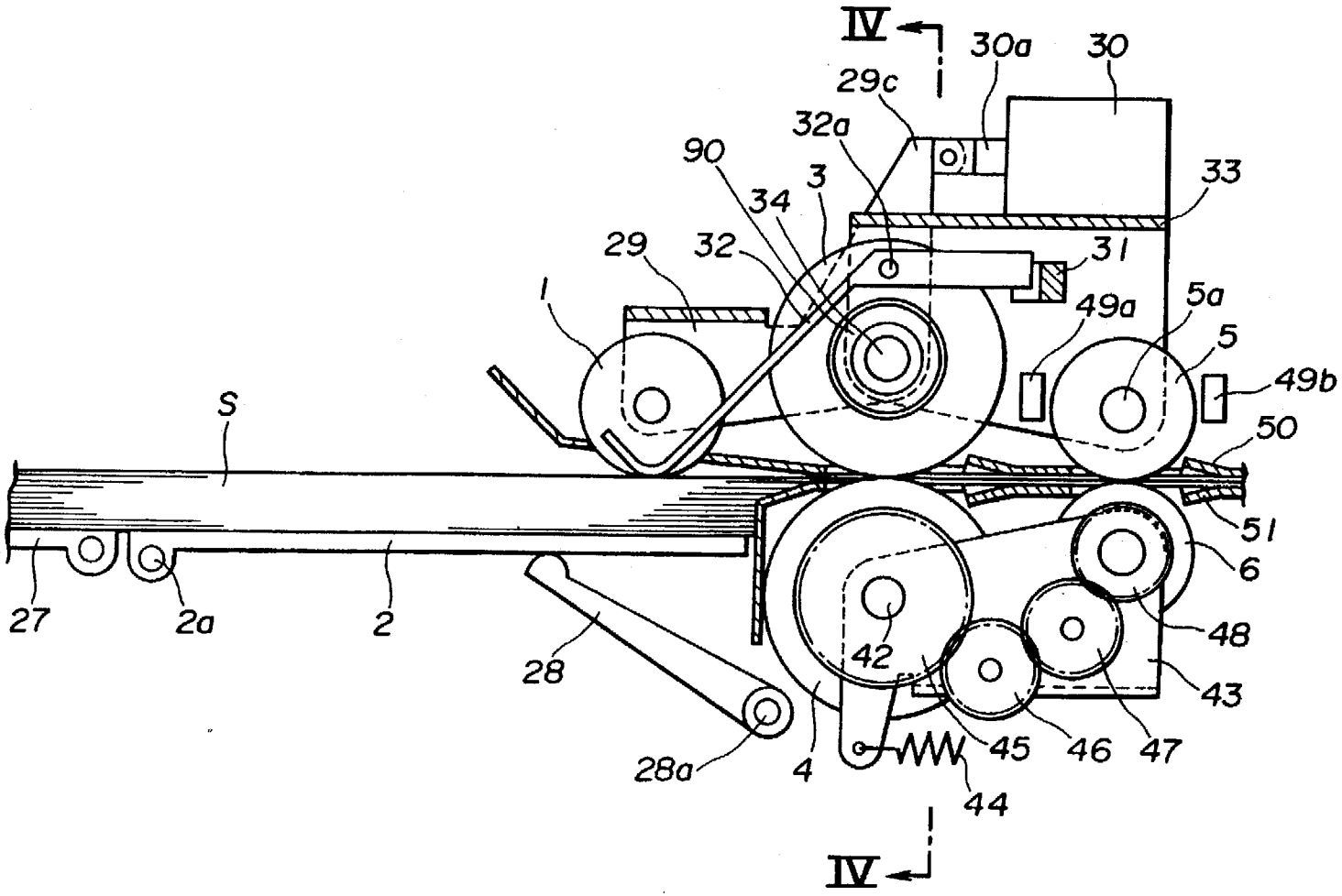
FIG. 2 is a cross-sectional view illustrating the configuration of a sheet separation device.
Figure 3:
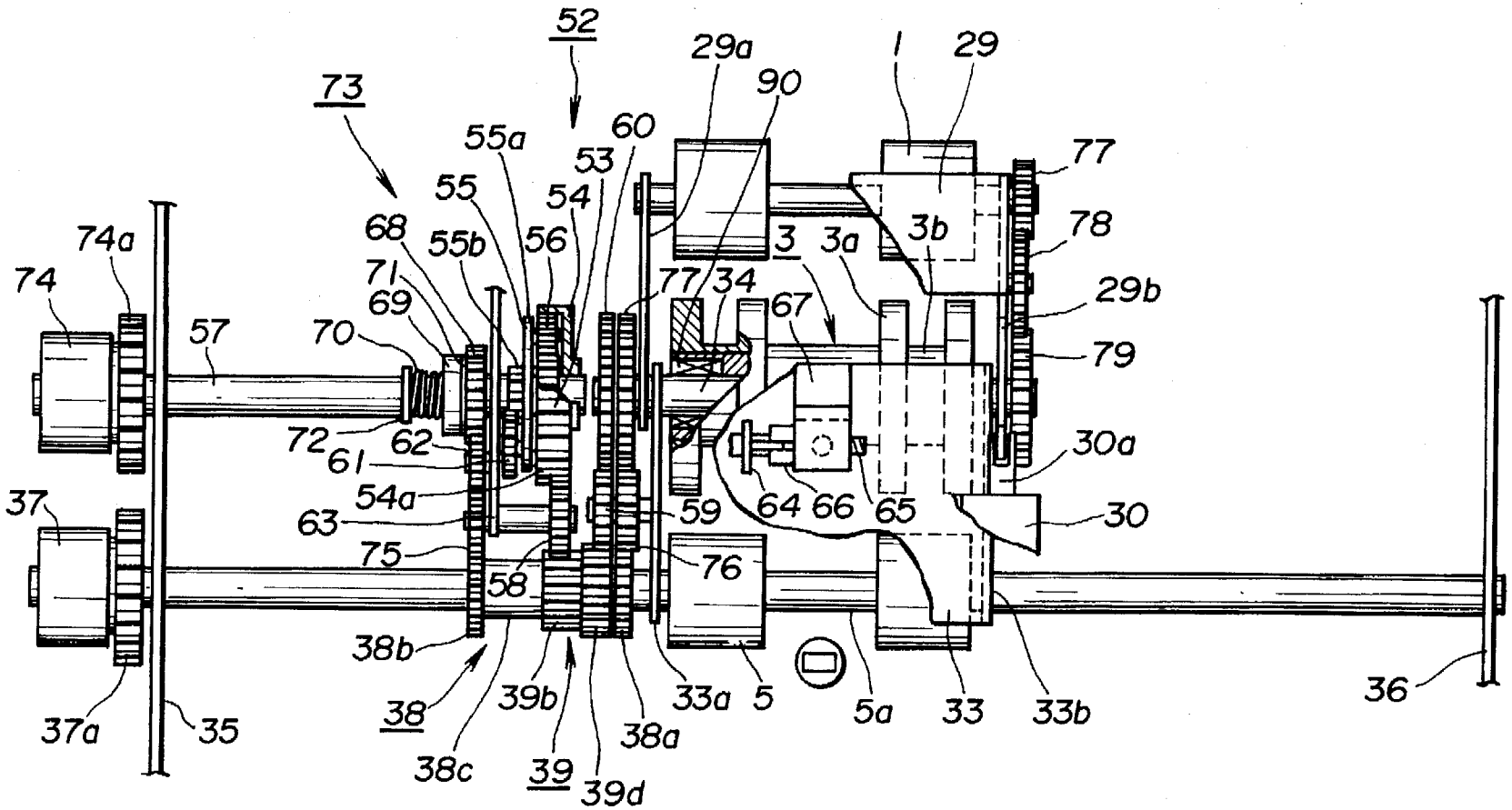
FIG. 3 is a plan view of the sheet separating device.
Figure 4:
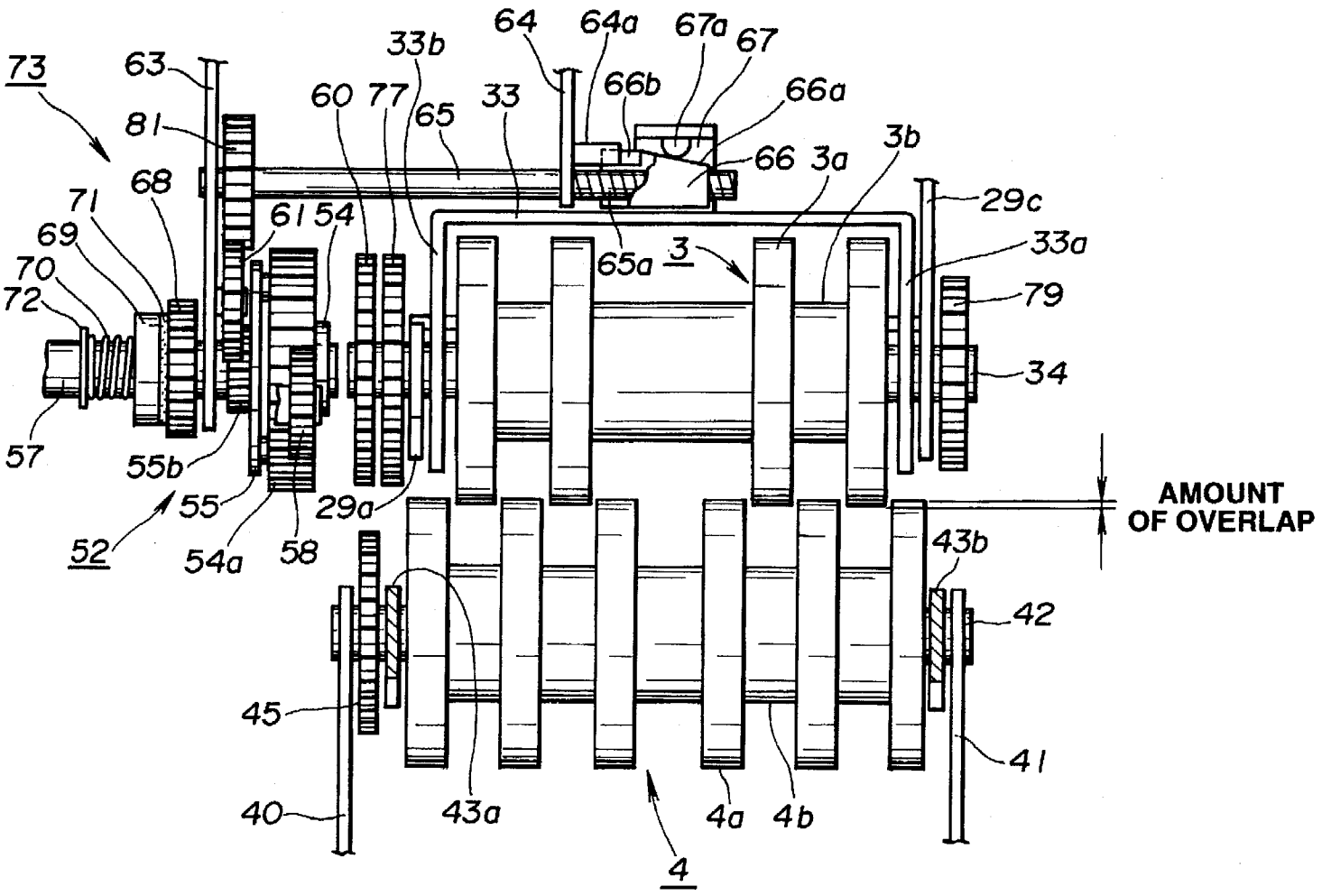
FIG. 4 is a cross-sectional view taken along line IV—IV shown in FIG. 2.
Figure 5:
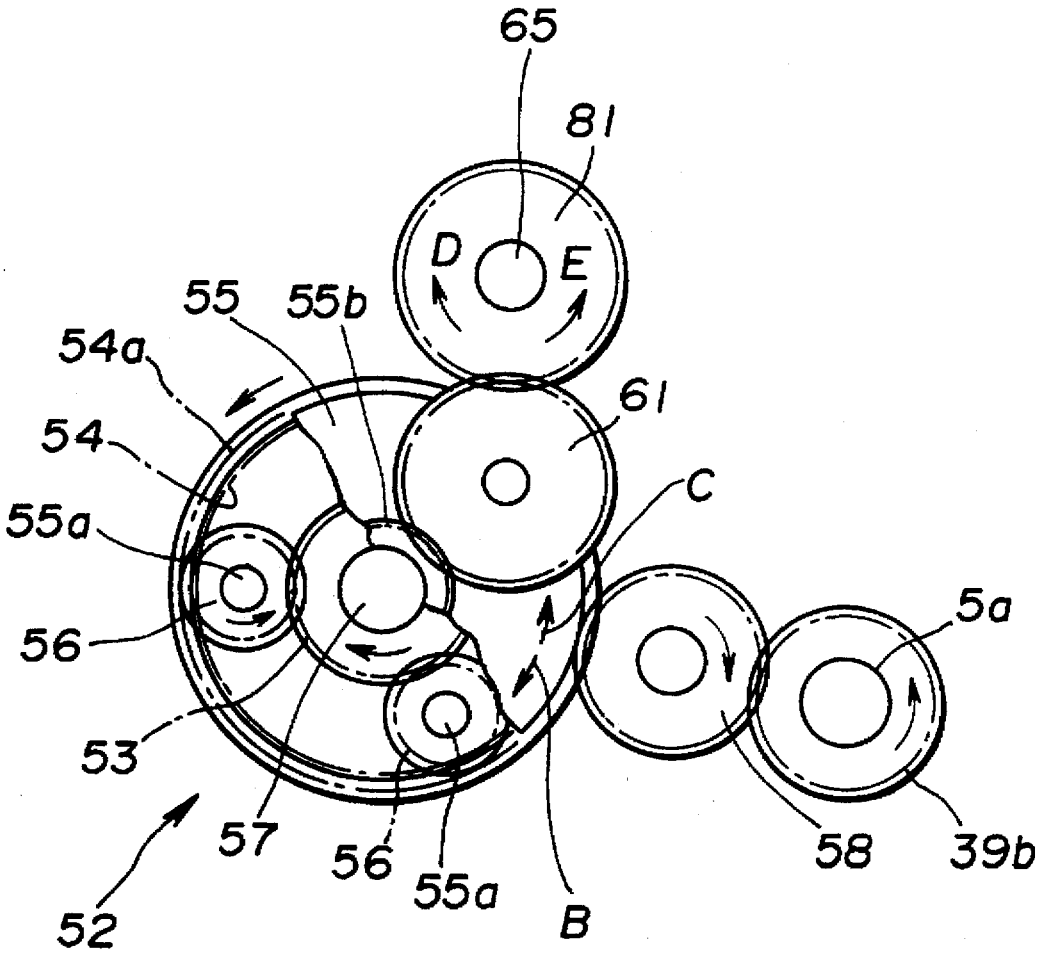
FIG. 5 is a schematic diagram illustrating the configuration of planetary gears.
Figure 6A:
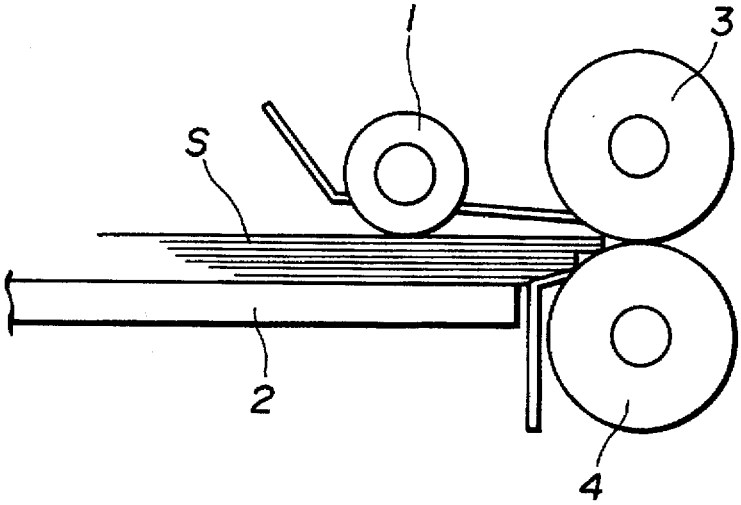
FIGS. 6(*a*) and 6(*b*) are schematic diagrams illustrating entrance of originals into separation rollers.
Figure 6B:
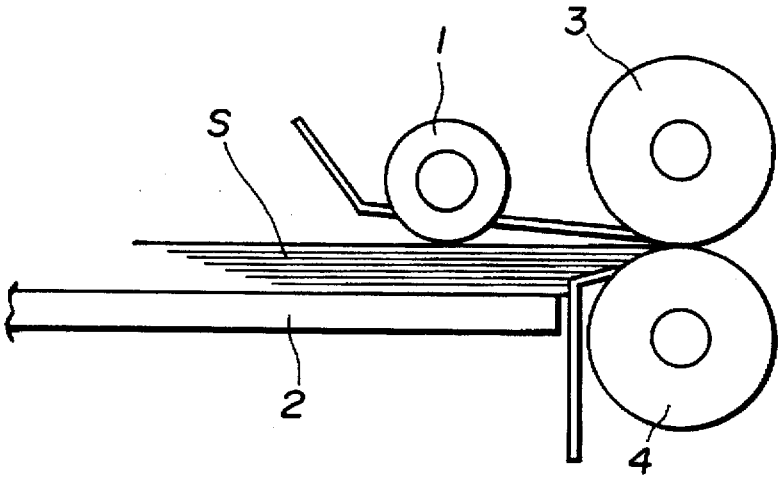
Figure 7:
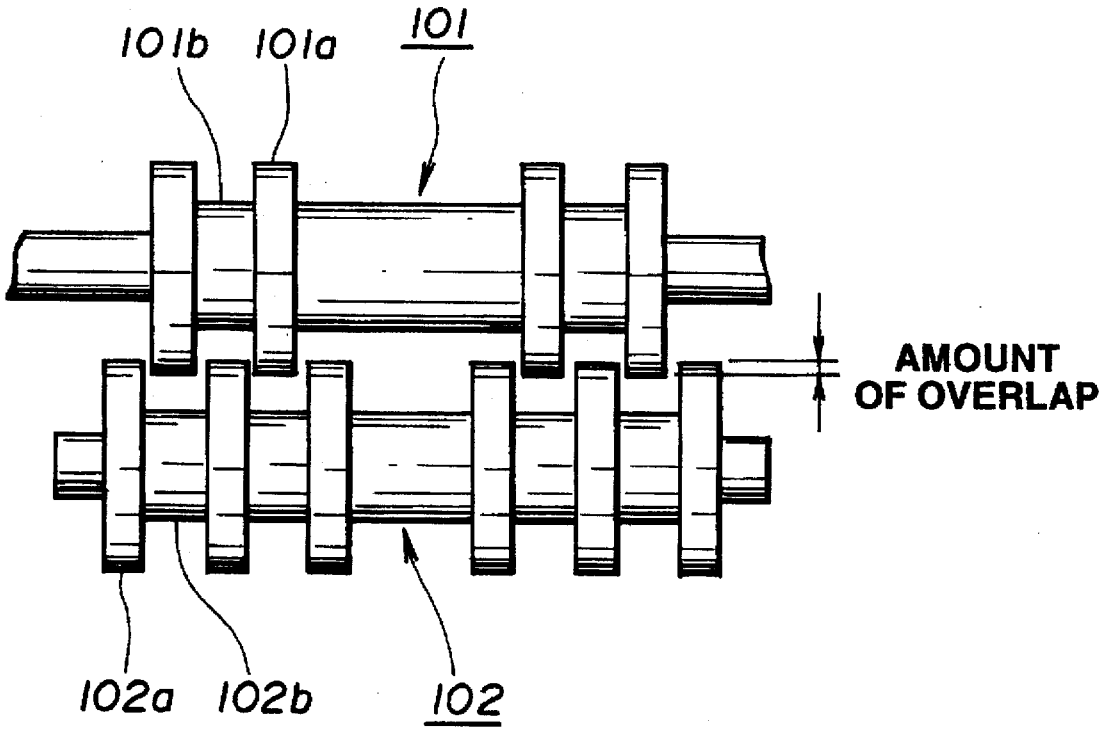
FIG.7 PRIOR ART
FIG. 7 is a schematic diagram illustrating the configuration of a conventional sheet separation device.

A description will now be provided of a sheet separation device, to which the above-described means is applied, according to an embodiment of the present invention with reference to the drawings. In the present embodiment, an electronic filing apparatus including the sheet separation device will be described. FIG. 1 is a cross-sectional view illustrating the entire configuration of an electronic filing apparatus. FIG. 2 is a cross-sectional view illustrating the configuration of a sheet separation device. FIG. 3 is a plan view of the sheet separating device. FIG. 4 is a cross-sectional view taken along line IV—IV shown in FIG. 2. FIG. 5 is a schematic diagram illustrating the configuration of planetary gears. FIGS. 6(*a*) and 6(*b*) are schematic diagrams illustrating entrance of originals into separation rollers.

First, a description will be provided of the schematic configuration of the electronic filing apparatus with reference to FIG. 1. The electronic filing apparatus has the functions of individually feeding mounted sheets of originals (hereinafter termed "originals"), reading images on both surfaces of an original, displaying the images on a display, and recording them in a recording apparatus. Thereafter, the electronic filing apparatus also retrieves an image recorded in the recording apparatus and displays the image on the display.

In FIG. 1, a sheet feeding roller 1 feeds originals S mounted on an original mount 2 into the apparatus. Comb-shaped rollers 3 and 4, each having large-diameter portions and small-diameter portions, are disposed so that the large-diameter portions of one of the rollers face the small-diameter portions of the other roller, and the small-diameter portions of the one roller faces the large-diameter portions of the other roller. By rotatably driving the comb-shaped roller 3 in a forward direction with respect to an original-feeding direction, and rotatably driving the comb-shaped roller 4 in a reverse direction with respect to the original-feeding direction, the originals S fed by the sheet feeding roller 1 are individually separated and fed. Reference numerals 5 and 6 represent a pair of registration rollers. Skew of the original S separated and fed by the comb-shaped rollers 3 and 4 is corrected by pressing the original S against a nip between the pair of registration rollers 5 and 6 being stopped, and the original S is then fed by rotatably driving the registration rollers 5 and 6 at a predetermined timing. The original S is further fed by a pair of feeding rollers 7 and 8, and a pair of feeding rollers 9 and 10 rotating at a constant speed. At that time, the two surfaces of the original S are illuminated by light sources 11 and 12 via transparent portions 13*a* and 14*a* provided in guide plates 13 and 14, respectively. Reflected light beams from the two surfaces of the original S are imaged onto image reading sensors 19 and 20, such as CCD's (charge-coupled devices) or the like, via plane mirrors 15*a*, 15*b* and 15*c*, and plane mirrors 18*a*, 16*b* and 16*c*, and imaging lenses 17 and 18, respectively, so that images on the two surfaces of the original S are read.

The read images of the original S are displayed on a display device 21, and are recorded on a recording device 22, such as a magnetooptical disk or the like. The images of the original S recorded on the recording device 22 can be appropriately retrieved and displayed on the display device 21.

The original S whose images have been read is discharged onto a sheet discharging unit 25 provided at an upper portion of the apparatus after being grasped and conveyed by conveying belts 23 and 24. Reference numeral 26 represents any known electronic unit including a power supply, a control substrate and the like for causing the apparatus to perform the above-described operations.

Next, the configuration of the sheet separation device mounted in the above-described electronic filing apparatus will be described in detail with reference to FIGS. 2 through 4. In FIG. 2, a tray 27 for mounting the originals S is disposed so as to be connected to the orignal mount 2. The original mount 2 is mounted so as to be rotatable around a shaft 2*a*, and is rotated by contact from a lever 28 which is itself rotatable around a shaft 28*a*.

The sheet feeding roller 1 is rotatably mounted on a U-shaped member 29 having side portions 29*a* and 29*b* (see FIG. 3). A solenoid 30 is connected to one end 29*c* of the U-shaped member 29 via a plunger 30*a*.

An original-detection sensor 31 detects the original S according to a sensor lever 32 rotating around a shaft 32*a*. The rotating operation of the pushing lever 28 is controlled based on a signal from the sensor 31 so that the upper surface of the originals S is always situated at a constant position.

As shown in FIG. 4, the comb-shaped roller (hereinafter termed a "feed roller") 3 has large-diameter portions 3*a* and small-diameter portions 3*b*, and is integrally mounted on a shaft 34 rotatably supported on side portions 33*a* and 33*b* of a U-shaped member 33 via a one-way clutch 90. The U-shaped member 33 is rotatably mounted on a shaft 5*a* of the registration roller 5, as shown in FIG. 2, and is driven in a counterclockwise direction in FIG. 2 around the shaft 5*a* by a spring (not shown).

As shown in FIG. 3, the shaft 5*a* of the registration roller 5 is rotatably supported on left and right side plates 35 and 36. An electromagnetic clutch 37 and a clutch gear 37*a* are mounted on an end portion (a left-end portion in FIG. 3) of the shaft 5*a*, and drive transmission control input from the clutch gear 37*a* is performed. A gear 38 having teeth 38*a* and 38*b* and a cylindrical portion 38*c* is rotatably mounted on the shaft 5*a*. A gear 39 having teeth 39*a* and 39*b* is rotatably mounted on the cylindrical portion 38*c* of the gear 38.

As shown in FIG. 4, the comb-shaped roller (hereinafter termed a "retard roller") 4 has large-diameter portions 4*a* and small-diameter portions 4*b*, and is integrally mounted on a shaft 42 rotatably supported on side plates 40 and 41. As described above, the feed roller 3 and the retard roller 4 are disposed so that the large-diameter portions 3*a* face the small-diameter portions 4*b*, and the small-diameter portions 4*b* face the large-diameter portions 4*a*.

In FIGS. 2 and 4, a U-shaped member 43 has side portions 43*a* and 43*b*, and is rotatably mounted on a shaft 42 rotatably supported on the side plates 40 and 41. The registration roller 6 is rotatably supported on the U-shaped member 43, and is urged in a counterclockwise direction around the shaft 42 by a spring 44 shown in FIG. 2 so as to be pressed against the registration roller 5. As shown in FIG. 2, the retard roller 4 is connected to the registration roller 6 via gears 45, 46, 47 and 48, and is rotated in a counterclockwise direction in FIG. 2 in accordance with the rotation of the pair of registration rollers 5 and 6.

In FIG. 2, there are also shown fed-sheet sensors 49*a* and 49*b* for detecting the end portion of an original, and sheet feeding guides 50 and 51.

Next, a description will be provided of a planetary-gear device 52 constituting a differential mechanism with reference to FIGS. 3 and 5.

In FIG. 5, the planetary-gear device 52 includes a sun gear 53 at the input side, and an inner gear 54 and a carrier 55 at the output side. A planetary gear 56 is rotatably mounted on a shaft 55*a* secured on a side of the carrier 55. The sun gear 53 is integrally mounted on a shaft 57 rotatably supported on side plates 35 and 63 shown in FIG. 3. Similarly, the inner gear 54 is rotatably mounted on the shaft 57, and a gear 54*a* is formed on the outer circumference of the inner gear 54. The carrier 55 mounting the planetary gear 56 is rotatably mounted on the shaft 57, and a gear 55*b* is integrally mounted on a side of the carrier 55. In FIG. 3, the first-output-side gear 54*a* provided on the outer circumference of the inner gear 54 is connected to a gear 60 integrally mounted on the shaft 34 of the roller 3 via gears 58, 39 and 59. The second-output-side gear 55*b* provided on the carrier 55 is connected to a gear 81 via a gear 61. The gear 81 is integrally mounted on a separation adjusting shaft 65, serving as adjusting means, rotatably mounted on side plates 63 and 64.

As shown in FIG. 4, a screw portion 65*a* is provided at one end (the right end in FIG. 4) of the separation adjusting shaft 65, and an inclined member 66 having an inclined portion 66*a* is fitted in the screw portion 65*a*. A groove 66*b* is provided in the inclined member 66, in which a protruded portion 64*a* of the side plate 64 is fitted. Accordingly, the inclined member 66 slides only in an axial direction by the rotation of the separation adjusting shaft 65. A semispherical portion 67*a* of a positioning member 67 integrally mounted on the U-shaped member 33 contacts the inclined portion 66*a* of the inclined member 66 so as to regulate the position of the U-shaped member 33. A gear 68, whose movement is regulated to be only in an axial direction, is rotatably mounted on the shaft 57 on which the planetary-gear device 52 is mounted. In addition, a pressing member 89 which can move only in an axial direction is integrally mounted on the shaft 57. The pressing member 69 presses the side of the gear 68 in an axial direction via a frictional plate 71 by being pressed by a spring 70. A stopper 72 provides the spring 70 with a pressing force. The frictional plate 71, the pressing member 69, the spring 70 and the stopper 72 constitute a frictional mechanism 73, which serves as friction transmission means.

In FIG. 3, an electromagnetic clutch 74 and a clutch gear 74*a* are mounted on an end (the left end in FIG. 3) of the shaft 57, and drive transmission control input from the clutch gear 74*a* is executed.

The gear 68 is connected to a gear 77 integrally mounted on the shaft 34 of the feed roller 3 via gears 75, 38 and 76.

The number of revolutions transmitted from the shaft 57 to the feed roller 3 when transmitting the drive from the gear 68 to the gear 77 integrally mounted on the shaft 34 of the feed roller 3 via the gears 62, 75, 38 and 76 is set to be greater than the number of revolutions when transmitting the drive from the gear 54*a* of the inner gear 54 to the gear 60 integrally mounted on the shaft 34 of the feed roller 3 via the gears 58, 39 and 59.

The drive transmission force in the frictional mechanism 73, converted into a value on the shaft 34 of the feed roller 3, is set to be substantially the same as the value of the load torque applied to the feed roller 3 when appropriate separation is performed duping sheet feeding.

As shown in FIG. 3, the sheet feeding roller 1 and the feed roller 3 are configured so that the drive is transmitted via gears 77, 78 and 79.

Next, a description will be provided of a sheet separation operation as well as a drive transmission operation in the above-described sheet separation device. When a recording operation has been started by depressing a switch (not shown), the pushing lever 28 shown in FIG. 2 rotates in a clockwise direction around the shaft 28*a* causing the original mount 2 to rotate counterclockwise. The uppermost sheet of the originals S mounted on the original mount 2 thereby contacts the sensor lever 32 to rotate it clockwise about shaft 32*a*. When the original-detection sensor 31 has detected an end portion of the sensor lever 32, the rotation of the pushing lever 28 is stopped. When the recording operation has been started as a result of depression of the switch, the solenoid 30 and the electromagnetic clutch 74 start to operate at the same time.

By operation of the solenoid 30, the U-shaped member 29 is rotated in a clockwise direction around the shaft 34 of the feed roller 3 to move the sheet feeding roller 1 upward. In FIG. 3, by the operation of the electromagnetic clutch 74, the clutch gear 74*a* is connected to the shaft 57, so that the sun gear 53 of the planetary-gear device 52 rotates in a clockwise direction in FIG, 5, and the gear 68 rotates via the frictional mechanism 73. At that time, since the original S is not fed to a separation position, no load is applied to the feed roller 3. Accordingly, the drive via the frictional mechanism 73 is transmitted to the feed roller 3 without causing slip, and the feed roller 3 is rotated in a counterclockwise direction in FIG. 2.

At that time, since the number of revolutions transmitted directly from the gear 68 is greater than the number of revolutions transmitted from the sun gear 53 of the planetary-gear device 52, the inner gear 54 rotates at a speed higher than when it rotates in a state in which the carrier 55 stops. Due to this difference in the revolution speed, the carrier 55 rotates in a direction indicated by an arrow C in FIG. 5 to rotate the separation adjusting shaft 65 in a direction indicated by an arrow E.

The inclined member 66 thereby moves toward the left in FIG. 4, whereby the positioning member 67 contacting the inclined portion 66*a* moves downward. That is, the positioning member 67 rotates the U-shaped member 33 in a counterclockwise direction in FIG. 2 around the shaft 5*a* to reduce the center distance between the feed roller 3 and the retard roller 4. In FIG. 4, when the inclined member 66 moves toward the left and an end of the inclined member 66 contacts the side plate 64, the rotation of the separation adjusting shaft 65 stops because the frictional force by the frictional mechanism 73 cannot rotate the separation adjusting shaft 65 any further.

At that time, the center distance between the feed roller 3 and the retard roller 4 is minimized. This minimized position is determined based on the thinnest original S to be supplied to the apparatus. If the position where the inclined member 66 contacts the side plate 64 can be adjusted, the optimum position to minimize the time required for the movement of the inclined member 66 can be determined in accordance with the thickness of the original S.

When the feed roller 3 reaches the lowermost point, the electromagnetic clutch 74 is interrupted. At the same time, power supply to the solenoid 30 is interrupted, whereby the U-shaped member 29 rotates in a counterclockwise direction in FIG. 2 around the shaft 34 due to its own weight to cause the sheet feeding roller 1 to contact the uppermost surface of the originals S.

Then, the electromagnetic clutch 74 operates again to connect the clutch gear 74*a* to the shaft 57 shown in FIG. 3. As described above, by the drive from both the drive transmission path via the planetary-gear device 52 and the drive transmission mechanism via the frictional mechanism 73, the sheet feeding roller 1 is rotated in a counterclockwise direction in FIG. 2, as well as the feed roller 8, via the gears 79, 78 and 77. The originals S mounted on the original mount 2 are thereby fed to the separation position.

Feeding of sheets after the second sheet of the originals S is prevented by the retard roller 4, and the uppermost sheet of the originals S mounted on the original mount 2 is fed between the feed Poller 3 and the retard roller 4. At that time, since the feed roller 3 feeds the original S against the retard roller 4, a load from the original S operates. When this load is greater than a value set by the frictional mechanism 73, slip is produced in the frictional mechanism 73, whereby the number of revolutions of the feed roller 3 is reduced. The rotation of the inner gear 54 of the planetary-gear device 52 is thereby retarded, and the carrier 55 rotates in a direction indicated by an arrow B in FIG. 5 by an amount of reduction in the number of revolutions of the inner gear 54 from a value in a state in which the carrier 55 stops.

The separation adjusting shaft 65 thereby rotates in a direction indicated by an arrow D in FIG. 5 to move the inclined member 86 shown in FIG. 4 toward the right. The positioning member 67 contacting the inclined portion 66*a* is thereby moved upward. That is, the positioning member 67 rotates the U-shaped member 33 in a counterclockwise direction in FIG. 2 around the shaft 5*a* to increase the center distance between the feed roller 3 and the retard roller 4. The amount of overlap between the feed roller 3 and the retard roller 4 is thereby reduced.

As the amount of overlap is reduced, the load applied to the feed roller 3 is reduced. The amount of slip of the frictional mechanism 73 is thereby reduced to increase the number of revolutions of the feed roller 3. When the number of revolutions of the feed roller 3 coincides with the number of revolutions of the feed roller 3 in a state in which the carrier 55 stops, the rotation of the carrier 55 is stopped.

Thereafter, the feed roller 3 and the retard roller 4 are driven by the frictional force of the frictional mechanism 73, so that the feed roller 3 rotates in a counterclockwise direction in FIG. 2 to feed the original S toward the pair of registration rollers 5 and 6. The number of revolutions of the feed roller 3 at that time equals the number of revolutions of the feed roller 3 in a state in which the carrier 5 stops. Accordingly, the frictional mechanism 73 transmits the drive to the feed roller 3 while producing slip.

When the leading edge of the original S is detected by the fed-sheet sensor 49*a*, the solenoid 30 operates to rotates the U-shaped member 29 in a clockwise direction and to move the sheet feeding roller 1 upward. The original S is fed to the pair of registration rollers 5 and 6 by the feed roller 3. When the leading edge of the original S contacts the nip portion between the pair of registration rollers 5 and 6, power supply to the electromagnetic clutch 74 is interrupted to stop the rotation of the feed roller 3.

While the original S is fed by the feed roller 3, the load applied to the feed roller 3 changes when the sheet feeding roller 1 contacts and leaves the original S. However, since the amount of the change is much smaller than the frictional force of the frictional mechanism 73, the change does not significantly influence the rotation relationship between the inner gear 54 of the planetary-gear device 52 and the carrier 55.

The original S waiting in a state of being pressed against the nip portion between the pair of registration rollers 5 and 6 is grasped and fed by the feed roller 3 and the pair of registration rollers 5 and 6 driven by linked operations of the electromagnetic clutches 37 and 74 operating at an appropriate timing. When the leading edge of the original S is detected by the fed-sheet sensor **49*b* shown in FIG. 2, power supply to the electromagnetic clutch 74 is interrupted to stop the drive for the feed roller 3, so that the original S is fed to the next step while being grasped by the pair of registration rollers 5 and 6**. Then, the above-described series of operations are performed.

After the drive for the electromagnetic clutch 74 has been stopped, the feed roller 3 is rotated caused by the movement of the original S, thereby intending to rotate the inner gear 54 in a counterclockwise direction in FIG. 5. Since the rotation of the sun gear 53 is stopped by the stoppage of the electromagnetic clutch 74, the driving force by the rotation of the feed roller 3 rotates the carrier 55 in the direction of the arrow C so as to shorten the center distance between the feed roller 3 and the retard roller 4. However, since the feed roller 3 is mounted on the shaft 34 via the one-way clutch 90, the driving force by the rotation of the feed roller 3 is not transmitted to the shaft 34 by the function of the one-way clutch 90. Accordingly, the center distance between the feed roller 3 and the retard roller 4 is maintained constant even after the stoppage of the electromagnetic clutch 74.

When the trailing edge of the original S is detected by the fed-sheet sensor **49*a*, power supply to the solenoid 30 is interrupted at an appropriate timing, and the U-shaped member 29 rotates in a counterclockwise direction due to its own weight around the shaft 34 to cause the sheet feeding roller to contact the uppermost surface of the originals S. Then, the electromagnetic clutch 74 operates, so that the sheet feeding roller 1 and the feed roller 3** rotate again to feed the original S into the apparatus.

According to the above-described operations, the originals S are sequentially fed, the position of the surface of the originals S is thereby lowered, the sensor lever 32 contacting the surface of the originals S rotates in a counterclockwise direction to leave the original-detection sensor 31, and the pushing lever 28 thereby rotates to raise the original mount 2. When the sensor lever 32 is detected by the original-detection sensor 31, the rotation of the pushing lever 28 is stopped. Thus, the device is controlled so as to detect the position of the surface of the originals S by the original-detection sensor 31, and to arrange the position of the uppermost sheet of the originals S within a predetermined range.

When the subsequently fed original S is of the same kind as the first original S, the load applied to the feed roller 3 does not change. Hence, the carrier 55 of the planetary-gear device 52 remains to stop, and the feed roller 3 and the sheet feeding roller 1 rotate by the frictional force of the frictional mechanism 73.

When the fed original S is thicker than the first original S, and the load applied to the feed roller 3 is therefore greater than a value set by the frictional mechanism 73, slip is produced in the frictional mechanism 73 to retard the rotation of the feed roller 3, as described above. When the number of revolutions of the feed roller becomes smaller than the value in a state in which the carrier 55 stops, the carrier 55 rotates in the direction indicated by the arrow B shown in FIG. 5 due to the difference in the number of revolutions. The separation adjusting shaft 65 is thereby rotated in the direction indicated by the arrow D to increase the center distance between the feed roller 3 and the retard roller 4.

As a result, the load applied to the feed roller 3 is reduced, and slip in the frictional mechanism 73 is reduced, and therefore the revolution speed of the feed roller 3 increases. When the number of revolutions of the feed roller 3 equals the number of revolutions of the feed roller 3 in a state in which the carrier 55 stops, the carrier 55 stops, and the feed roller 3 and the sheet feeding roller 1 rotate by the frictional force of the frictional mechanism 73.

When the fed original S is thinner than the first original S, and therefore the load applied to the feed roller 3 is smaller than the load set by the frictional mechanism 73, the driving force via the frictional mechanism 73 is directly transmitted to the feed roller 3 without producing slip, and the feed roller 3 rotates at a speed higher than a speed via the drive transmission path from the planetary-gear device 52. Due to this difference in the revolution speed, the carrier 55 rotates in the direction indicated by the arrow C shown in FIG. 5, to rotate the separation adjusting shaft 65 in the direction indicated by the arrow E and thereby to reduce the center distance between the feed roller 3 and the retard roller 4.

As a result, the load applied to the feed roller 3 increases, and slip is produced again in the frictional mechanism 73, and therefore the revolution speed of the feed roller 3 decreases. When the number of revolutions of the feed roller 3 equals the number of revolutions of the feed roller 3 in a state in which the carrier 55 stops, the carrier 55 stops, and the feed roller 3 and the sheet feeding roller 1 rotate by the frictional force of the frictional mechanism 73 to feed the original S.

The above-described contents will now be summed up. The load applied to the feed roller 3 for feeding the original S is represented by $F_p$, the frictional force in the frictional mechanism 73 is represented by $F_f$ (both converted to values on the tangent of the feed roller 3), the number of revolutions of the feed roller 3 via the planetary-gear device 52 in a state in which the carrier 55 stops is represented by $N_O$, and the number of revolutions of the feed roller 3 when the load is applied is represented by $N_p$.

(1) When the load applied to the feed roller 3 is greater than the frictional force by the frictional mechanism 73, whereby slip is produced in the frictional mechanism 73, and the number of revolutions of the feed roller 3 becomes smaller than the number of revolutions in a state in which the carrier 55 stops, i.e., when $F_p>F_f$, and $N_p<N_O$, the carrier 55 rotates in accordance with the difference in the number of revolutions ($N_O-N_p$) to increase the center distance between the feed roller 3 and the retard roller 4.

(2) When the load applied to the feed roller 3 is substantially equal to the frictional force by the frictional mechanism 73, and the number of revolutions of the feed roller 3 equals the number of revolutions in a state in which the carrier 55 stops, i.e., when $F_p=F_f$, and $N_p=N_0$, the carrier 55 stops, and the center distance between the feed roller 3 and the retard roller 4 does not change.

(3) When the load applied to the feed roller 3 is smaller than the frictional force by the frictional mechanism 73, and therefore no slip is produced in the frictional mechanism 73, i.e., when $F_p<F_f$, and $N_p>N_0$, the carrier 55 rotates in accordance with the difference in the number of revolutions $(N_p-N_0)$ to reduce the center distance between the feed roller 3 and the retard roller 4.

As descibed above, by the forward or reverse rotation of the carrier 55 so as to provide a state in which the load $F_p$ applied to the feed roller 3 equals the frictional force $F_f$ set by the frictional mechanism 73, the center distance between the feed roller 3 and the retard roller 4 is adjusted. Accordingly, an appropriate separation force is determined by the frictional force $F_f$ of the frictional mechanism 73.

The actual values of the load $F_p$ and the frictional force $F_f$ differ depending on the kind of the original S, the material and the shape of the rollers, and ambient conditions. In an apparatus used by the inventors of the present invention, the value of the load $F_p$ applied to the feed roller 3 when appropriate separation can be performed for an A4-size sheet having a thickness of 0.05 mm–0.15 mm was 1.5N (≈150 gf)–6N (≈600 gf). The value of the frictional force $F_f$ by the frictional mechanism 73 is set to about 3N (≈300 gf) so that the value of the load $F_p$ is within the above-described range.

As described above, the center distance between the feed roller 3 and the retard roller 4 can be increased or decreased. Accordingly, even if the center distance between the feed roller 3 and the retard roller 4 changes due to a change in the load by some reason while the original S is fed, the feed roller 3 instantaneously moves to an appropriate separation position. Hence, a smooth separation operation can be performed.

In general, a rubber material is used for the pair of comb-shaped rollers. As friction between the feed roller 3 and the retard roller 4 is increased, a better separation performance is provided. However, since a roller providing large friction is soft and therefore tends to wear rapidly, the center distance between the feed roller 3 and the retard roller 4 must be changed in order to provide an appropriate separation force. Accordingly, when durability is required, wear must be taken into consideration, and therefore the separation performance must be sacrificed somewhat.

In the present embodiment, however, the center distance for separation is automatically controlled so as to provide a constant separation force, as described above. Hence, it is possible to adopt an optimum pair of rollers for separation without being limited to slow wearing rollers, and therefore to improve the separation performance.

In the above-described embodiment, when feeding the next original S after feeding of the first original S has been completed, power supply to the solenoid 30 is interrupted, and the electromagnetic clutch 74 is operated after the sheet feeding roller 1 has contacted the uppermost surface of the originals S. However, the electromagnetic clutch 74 may be first operated, and power supply to the solenoid 30 may be interrupted after the lapse of a predetermined time period.

When feeding of the first original S has been completed, the originals S do not enter between the feed roller 3 and the retard roller 4. Hence, the load due to the originals S, which causes variations, is not applied to the feed roller 3. Accordingly, driving by the frictional force by the frictional mechanism 73 operates so as to minimize the center distance between the feed roller 3 and the retard roller 4, so that the amount of overlap between the two rollers can be maximized. Hence, separation for the subsequently fed original S can be assuredly performed.

At that time, the originals after the second original are, in some cases, drawn by the first original S, and the leading edge of the next original S is beginning to enter the nip between the feed roller 3 and the retard roller 4 when feeding of the first original S has been completed. If the feed roller 3 is rotated in this state, the load of the original S is applied to the feed roller 3, and therefore it is impossible to rotate the feed roller 3 in a state in which no load is applied.

In the present embodiment, rotation of the feed roller 3 is stopped until the trailing edge of the first original S passes through the feed roller 3 and is detected by the fed-sheet sensor 49*a*, so that only the retard roller 4 is controlled so as to rotate linked with the registration roller 6. Since the rotation of the retard roller 4 is not stopped, the next original S, which has reached the separation position by being drawn by the first original S, is pushed back. Accordingly, it is possible to prevent the phenomenon that when rotating the feed roller 3, the next original S becomes the load for the feed roller 3 by being grasped between the feed roller 3 and the retard roller 4.

By linking driving for the sheet feeding roller 1 with driving for the feed roller 3, the sheet feeding roller 1 stops simultaneously when the feed roller 3 stops. Accordingly, the center distance for separation is adjusted, and particularly it is possible to prevent the phenomenon of when the revolution speed of the feed roller 3 decreases, the sheet feeding roller 1 continues to feed the original S, and the fed original S is jammed.

Although in the above-described embodiment, the center distance between the feed roller 3 and the retard roller 4 is adjusted so that the load applied to the feed roller 3 is constant, the load applied to the retard roller 4 may be adjusted to be constant. In this case, however, as shown in FIG. 6(*a*), a bundle of originals S may be fed between the feed roller 3 and the retard roller 4, thereby providing the retard roller 4 with a large load. In such a state, the center distance between the feed roller 3 and the retard roller 4 increases more than necessary, and therefore an appropriate separation operation is not performed. In order to prevent such a phenomenon, the leading edges of the originals S may be set while being obliquely shifted, as shown in FIG. 6(*b*). It is thereby possible to prevent the above-described abnormal load applied to the retard roller 4. In the configuration of the present embodiment in which the load applied to the feed roller 3 is made constant, such a problem does not arise.

Although in the present embodiment, when adjusting the center distance between the feed roller 3 and the retard roller 4 so that the load applied to the feed roller 3 is kept constant, the feeding roller 3 is moved, and the retard roller 4 may be moved. However, if the center distance is adjusted by moving the retard roller 4, the drive transmission distance from the output side of the planetary-gear device 52 increases, thereby increasing mechanical loss and the size of the apparatus.

To the contrary, in the present embodiment, the driving of the feed roller 3 and the retard roller 4 and the adjustment of the center distance between the feed roller 3 and the retard roller 4 are performed at the same side with respect to the sheet feeding path. That is, the drive transmission path for the feed roller 3 and the drive transmission path to the separation adjusting shaft 65, serving as position adjusting means for the feed roller 3, are connected to the output side of the planetary-gear device 52. It is thereby possible to shorten the drive transmission path to the feed roller 3 and the drive transmission path to the separation adjusting shaft 65 connected to the planetary-gear device 52, and therefore, to contribute to reduction in the size of the apparatus and to suppress mechanical loss in the drive transmission system.

In the present embodiment, the sun gear 53, and the carrier 55 and the inner gear 54 are used at the input side and the output side of the planetary-gear device 52, respectively, and the carrier side is used for driving for separation adjustment, and the inner gear side is used for driving of the feed roller. However, the carrier side may be used for driving the feed roller, and the inner gear side may be used for driving for separation adjustment. As for the configuration of the input side and the output side, the input side may comprise the inner gear, and the output side may comprise the carrier and the sun gear. Alternatively, the input side may comprise the carrier, and the output side may comprise the sun gear and the inner gear.

Although in the present embodiment, a description has been provided illustrating an electronic filing apparatus as an apparatus in which a sheet separation device is mounted, the present invention is not limited to such an apparatus. For example, any other apparatus, such as a copier, a facsimile apparatus or the like, may be used instead of an electronic filing apparatus.

The individual components shown in outline in the drawings are all well known in the sheet feeding device arts and their specific construction and operation are not critical to the operation or the best mode for carrying out the invention.

While the present invention has been described with respect to what is presently considered to be the preferred emodiment, it is to be understood that the invention is not limited to the disclosed embodiment. To the contrary, the present invention is intended to cover various modifications and equivalent arrangements included within the spirit and scope of the appended claims.

What is claimed is:

1. A sheet feeding device comprising:

a feeding rotating means for feeding sheets in a sheet feeding direction;

separating means opposed to said feeding rotating means for separating the sheets one by one; and automatic adjustment means for automatically adjusting a relative position between said feeding rotating means and said separating means so that when a load on said feeding rotating means resulting from a sheet entering between said feeding rotating means and said separating means in the sheet feeding direction is greater than a predetermined value, the load is reduced, and when the load is smaller than the predetermined value, the load is increased.

2. A device according to claim 1, wherein said separating means comprises an inversely rotating member rotating in a direction tending to move a sheet in a direction reverse to the sheet feeding direction.

3. A device according to claim 2, wherein said automatic adjustment means adjusts the relative position by adjusting the distance between respective shafts of said feeding rotating means and said inversely rotating member.

4. A sheet feeding device comprising:

a feeding rotating member having a plurality of large-diameter portions and rotatable in a direction for feeding a sheet in a sheet feeding direction;

an inversely rotating member having a plurality of large-diameter portions alternately disposed and overlappable with respect to the large-diameter portions of said feeding rotating member and rotatable in a direction for feeding a sheet in a direction reverse to the sheet feeding direction; and automatic adjustment means for automatically adjusting an amount of the overlap between the large-diameter portions of said feeding rotating member and the large-diameter portions of said inversely rotating member so that when a load on said feeding rotating member resulting from a sheet entering between said feeding rotating member and said inversely rotating member in the sheet feeding direction is greater than a predetermined value, the amount of overlap is reduced, and when the load is smaller than the predetermined value, the amount of overlap is increased.

5. A device according to claim 4, wherein said rotating members are each rotatable about a shaft, and said automatic adjustment means adjusts the amount of overlap by adjusting the distance between the respective shafts of said feeding rotating member and said inversely rotating member.

6. A device according to claim 4, further comprising control means for controlling said sheet feeding device so that when consecutively feeding sheets, rotation of said feeding rotating member is stopped and rotation of said inversely rotating member is continued after a separated and fed sheet has passed through between said feeding rotating member and said inversely rotating member.

7. A sheet feeding device:

a feeding rotating member having a plurality of large-diameter portions and rotatable in a direction for feeding a sheet in a sheet feeding direction;

an inversely rotating member having a plurality of large-diameter portions alternately disposed and overlappable with respect to the large-diameter portions of said feeding rotating member and rotatable in a direction for feeding a sheet in a direction reverse to the sheet feeding direction; and automatic adjustment means for automatically adjusting an amount of the overlap between the large-diameter portions of said feeding rotating member and the large-diameter portions of said inversely rotating member, wherein said automatic adjustment means further comprises moving means for relatively moving said feeding rotating member and said inversely rotating member in an approaching direction and in a separating direction, and operation means for causing said moving means to perform an approaching operation and a separating operation in accordance with a load on said feeding rotating member from the sheet entering between said feeding rotating member and said inversely rotating member.

8. A device according to claim 7, wherein said operation means further comprises friction transmission means disposed in a drive transmission path for transmitting a driving force from a driving source to one of said feeding rotating member and said inversely rotating member, and a differential mechanism for causing said moving means to perform the approaching operation and the separating operation based on a difference between a direct driving force from the driving source and a driving force transmitted via said friction transmission means, wherein said differential mechanism causes said moving means to perform the approaching operation when the driving force transmitted via said friction transmission means is greater than the load caused by the sheet entering between said feeding rotating means and said inversely rotating means in the sheet feeding direction, and causes said moving means to perform the separating operation when the driving force transmitted via said friction transmission means is smaller than the load.

9. A device according to claim 8, wherein said differential mechanism comprises a planetary-gear mechanism, to which the direct driving force from the driving force and the driving force transmitted to one of said feeding rotating member and said inversely rotating member via said friction transmission means are input, said planetary-gear mechanism outputting rotation in different directions in accordance with the magnitude relationship between the two driving forces.

10. A device according to claim 9, wherein one of said feeding rotating member and said inversely rotating member is swingably supported by a swinging member so as to be approachable and separatable with respect to the other member, wherein said moving means further comprises a tapered portion advancable or retractable in accordance with a direction of rotation output from said planetary-gear mechanism, and wherein said tapered portion causes said feeding rotating member and said inversely rotating member to approach or separate from each other.

11. A device according to claim 8, wherein driving is transmitted to said feeding rotating member via the drive transmission path including said friction transmission means, and wherein said feeding rotating member approaches and separates from said inversely rotating member by operation of said moving means.

12. A device according to claim 11, further comprising conveying means downstream of,said feeding rotating member, wherein said conveying means and said inversely rotating means are disposed in the same drive transmission path, and are driven by the same drive source.

13. A device according to claim 12, further comprising detection means, provided downstream of said feeding rotating member, for detecting a trailing edge of a separated sheet, and control means for performing control so as to stop rotation of said feeding rotating member and to continue rotation of said conveying means and said inversely rotating member based on a detection of said detection means.

14. An image reading apparatus comprising:

feeding rotating means for feeding sheets in a sheet feeding direction;

separating means opposed to said feeding rotating means for separating the sheets one by one;

automatic adjustment means for automatically adjusting a relative position between said feeding rotating means and said separating means so that when a load on said feeding rotating means resulting from a sheet entering between said feeding rotating means and said separating means in the sheet feeding direction is greater than a predetermined value, the load is reduced, and when the load is smaller than the predetermined value, the load is increased; and reading means for reading an image formed on a sheet separated by said feeding rotating means and said separating means.

15. An image reading apparatus comprising:

a feeding rotating member having a plurality of large-diameter portions and rotatable in a direction for feeding a sheet in a sheet feeding direction;

an inversely rotating member having a plurality of large-diameter portions alternately disposed and overlappable with respect to the large-diameter portions of said feeding rotating member and rotatable in a direction for feeding a sheet in a direction reverse to the sheet feeding direction;

automotive adjustment means for automatically adjusting an amount of the overlap between the large-diameter portions of said feeding rotating member and the large-diameter portions of said inversely rotating member so that when a load on said feeding rotating member resulting from a sheet entering between said feeding rotating member and said inversely rotating member in the sheet feeding direction is greater than a predetermined value, the amount of overlap is reduced, and when the load is smaller than the predetermined value, the amount of overlap is increased; and reading means for reading an image formed on a sheet separated by said feeding rotating member and said inversely rotating member.

16. An image reading apparatus comprising:

a feeding rotating member having a plurality of large-diameter portions and rotatable in a direction for feeding a sheet in a sheet feeding direction;

an inversely rotating member having a plurality of large-diameter portions alternately disposed and overlappable with respect to the large-diameter portions of said feeding rotating member and rotatable in a direction for feeding a sheet in a direction reverse to the sheet feeding direction;

automatic adjustment means for automatically adjusting an amount of the overlap between the large-diameter portions of said feeding rotating member and the large-diameter portions of said inversely rotating member, wherein said automatic adjustment means further comprises moving means for moving said feeding rotating member and said inversely rotating member in an approaching direction and in a separating direction, and operation means for causing said moving means to perform an approaching operation and a separating operation in accordance with the load on said feeding rotating member from the sheet entering between said feeding rotating member and said inversely rotating member; and reading means for reading an image formed on a sheet separated by said feeding rotating member and said inversely rotating member.

* * * * *

UNITED STATES PATENT AND TRADEMARK OFFICE

CERTIFICATE OF CORRECTION

PATENT NO. : 5,678,817
DATED : October 21, 1997
INVENTOR(S) : Yoshihiro SAITO, et al.

It is certified that error appears in the above-identified patent and that said Letters Patent is hereby corrected as shown below:

Column 5, line 10, delete "18a" and insert therefor --16a--.

Column 8, line 26, delete "Poller" and insert therefor --roller--.

Column 15, line 29, after "of", delete the comma (",").

Signed and Sealed this

Seventeenth Day of March, 1998

*Attest:*

*Attesting Officer*

BRUCE LEHMAN

*Commissioner of Patents and Trademarks*